United States Patent [19]

Guillaume

[11] Patent Number: 4,492,483

[45] Date of Patent: Jan. 8, 1985

[54] MEANS FOR DETECTING THE END OF A RIBBON FOR TYPEWRITERS

[75] Inventor: Errick Guillaume, Moudon, Switzerland

[73] Assignee: Hermes Precisa International S.A., Yverdon, Switzerland

[21] Appl. No.: 473,328

[22] Filed: Mar. 8, 1983

[30] Foreign Application Priority Data

May 14, 1982 [CH] Switzerland ..... 3005/82

[51] Int. Cl.[3] ..... B41J 35/28

[52] U.S. Cl. ..... 400/208; 400/249; 242/199

[58] Field of Search ..... 400/249, 207, 208, 208.1, 400/708, 711, 707.1, 219.1; 226/11, 45; 242/197, 198, 199

[56] References Cited

U.S. PATENT DOCUMENTS

| | | | |
|---|---|---|---|
| 3,305,188 | 2/1967 | Sampson | 242/197 |
| 3,398,290 | 8/1968 | Basehore et al. | 250/221 X |
| 3,497,157 | 2/1970 | Hanes et al. | 242/198 X |
| 3,615,155 | 10/1971 | Gelbman | 242/199 X |
| 3,638,955 | 2/1972 | Wada | 242/197 X |
| 4,401,394 | 8/1983 | Hume et al. | 400/249 X |

FOREIGN PATENT DOCUMENTS

| | | | |
|---|---|---|---|
| 8286 | 1/1981 | Japan | 400/249 |

*Primary Examiner*—Paul T. Sewell
*Assistant Examiner*—Charles A. Pearson
*Attorney, Agent, or Firm*—Emory L. Groff, Jr.

[57] ABSTRACT

The detection means for the ends of a ribbon for typewriters includes a light flow conductor member 17 integral with the bottom 2 of the case for the ribbon cassette. The member 17 has two light guides between which the ribbon passes. One of the guides is disposed in a manner to induce flow of light emitted by the light source opposite light source 15 opposite the ribbon, the other is disposed in such a manner as to conduct to the detector 16 the flow of light traversing the ribbon. Thus, the placing of the ribbon is facilitated and the optical reader does not risk damage when it is put in place. Since a new light conductor member is disposed in the light flow each time the cassette is changed, the detection of the end of the ribbon is not adversely affected by harmful deposits.

1 Claim, 4 Drawing Figures

MEANS FOR DETECTING THE END OF A RIBBON FOR TYPEWRITERS

The present invention concerns a detection means for the end of a ribbon for typewriters having a cassette comprising a case containing a supply spool on which the ribbon is wound and a receiving spool intended to cooperate with drive means and intended to receive the used ribbon. The detection means further comprises an optical reader comprising a luminous source for lighting a portion of said ribbon and a detector for detecting the flow of light coming from the lighted portion of the ribbon.

Modern typewriting machines frequently comprise a memory for recording texts. The printing of memorized text is then effected in automatic manner without the intervention of an operator. When the printed ribbon of such a machine reaches the end of the printing of the text which is to be memorized, it is necessary that the printing operation be automatically stopped and the operator be warned that the cassette should be changed.

Some machines include for this purpose an optical reader intended to detect the end of the printed ribbon. This reader generally comprises a light source and a photoelectric detector disposed opposite said source. When changing the cassette, it is therefore necessary to introduce the printed ribbon between the light source and the detector. This operation necessitates special care and it frequently happens that the elements of the optical reader are damaged when changing a ribbon.

Another inconvenience resides in the fact that after prolonged use of the machine, the luminous source and the detector are frequently coated by the deposit of ink coming from the ribbon or by dust thus being damaged by the prolonged passage of the printed ribbon. The proper functioning of the reader can in such case be disrupted.

The present invention has for its object overcoming these inconveniences and providing a cassette comprising a conductor member for the flow of light coming from a member within the case, said member being intended to lead the liminous flow originating from the lighted portion of the ribbon toward the detector.

The cassette according to the invention, facilitates putting the ribbon in place. In addition, the optical reader is not subjected to risk of damage when putting it in to place with the ribbon and, since a new light flow conductor member can be used each time that the cassette is changed, the detection of the end of the ribbon is not affected by harmful deposits.

The attached drawing illustrates schematically and by way of example, a preferred form of execution of a cassette for a printed ribbon according to means of the present invention.

Figure 1:
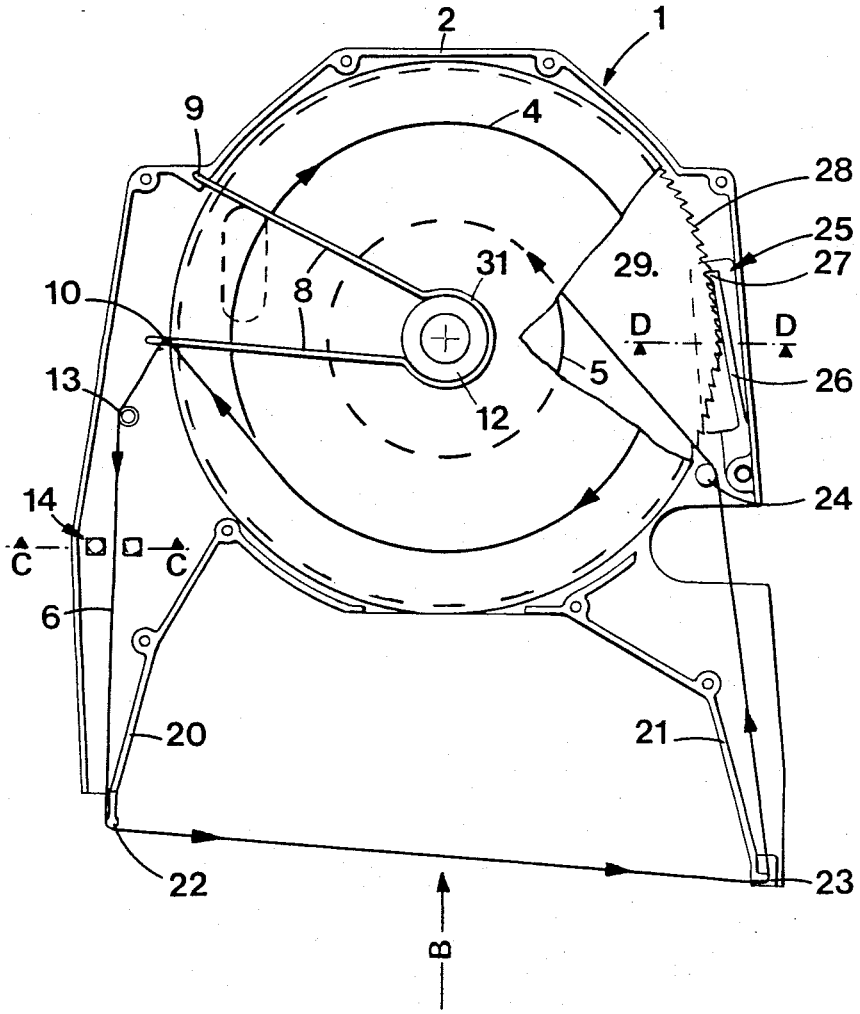
FIG. 1 is a plan view with the case being opened so as to show the different elements comprising the cassette.
Figure 2:
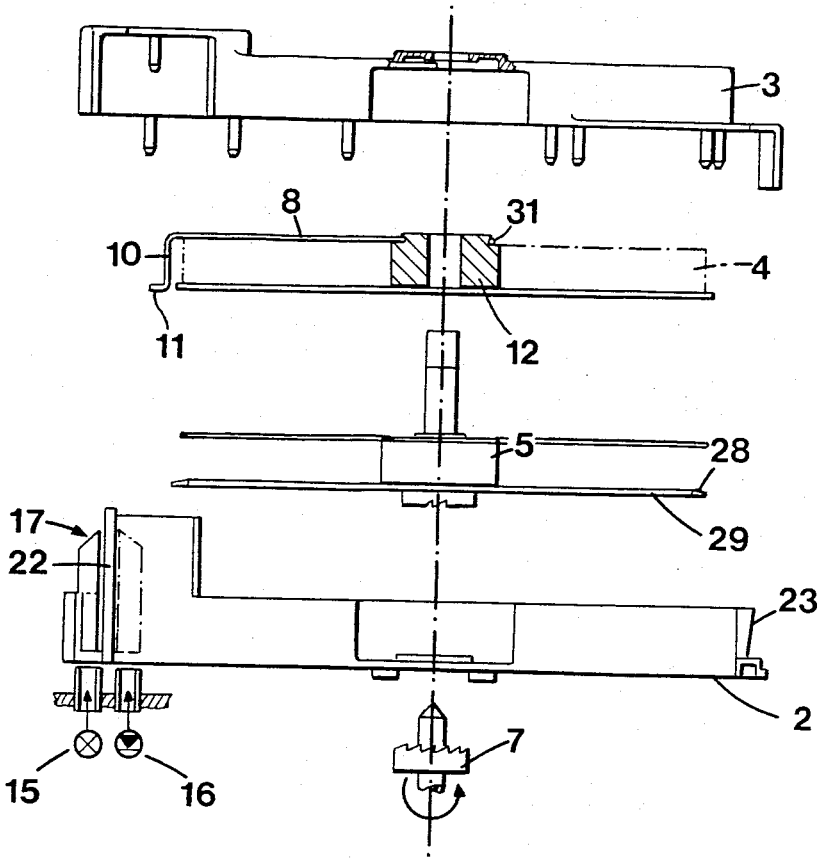
FIG. 2 is an exploded side view looking in the direction of the arrow B of FIG. 1.
Figure 3:
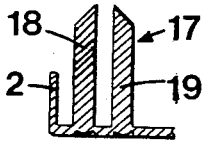
FIG. 3 is a section along the line C—C of FIG. 1.
Figure 4:
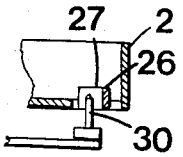
FIG. 4 is a section according to the line D—D of FIG. 1.

The ribbon cassette comprises a case 1 having a cover 3 fitting on a bottom 2, a supply spool 4 on which the printed ribbon 6 is wound and a receiving spool 5 around which said used ribbon is wound.

The supply spool 4 is superimposed coaxially with the receiving spool 5 which is rotatably driven by a drive means 7 outside the cassette.

The supply spool 4 includes braking means in order to produce a certain degree of tension on the printed ribbon 6. Said braking means comprises a steel wire spring 8 including a portion curled around a brake 31 on hub means 12 of the supply spool 4, an end 9 anchored in the case and an end 10 which includes a nose 11. The printed ribbon 6 passes around the bent end 10 of the wire spring 8 guided by the nose 11 before being wound on the guide 13 and across the optical reader 14.

When the ribbon 6 is stretched by the drive means 7 on the receiving spool 5, the tension of the ribbon on the bent end 10 tends to open the curled portion or loop of the brake 31 so that the ribbon 6 can be unwound. To stop the drive means 7, the loop of brake 31 cooperates with means 12 to brake the supply spool 5.

The optical reader 14 is intended to detect the end of the ribbon 6 and comprises a luminous source 15 and optoelectronic detector 16 and a light conductor 17. The luminous source 15 and the detector are fixed on the typewriter while the light conductor 17 is integral with the bottom 2 of case 1 of the cassette.

The light conductor 17 comprises two prismatic light guides 18 and 19. The upper ends of the two guides provide two faces oriented substantially at 45° to the axis of said guides in a manner to reflect the light from one of the guides toward the other. The printed ribbon 6 passes between the two upper faces of the guides 18 and 19. It is normally opaque but has a transparent end. When this transparent end reaches the optical reader 17, the luminous flow coming from the source 15 is transmitted by the ribbon to the other guide 19 in order to reach the optoelectronic detector 16.

The optoelectronic detector at this time emits a signal susceptible of acting, after adequate amplification, on the one hand on a part of an interpreter (not shown) thus permitting the stopping of the printing and, on the other hand, acting on an optical or sound signalling means (not shown).

The case 1 includes two extensions 20 and 21 whose ends are open and are provided with guide members 22 and 23. The portion of the ribbon 6 located in the exterior of the case 1 between the guide members 22 and 23 is intended to be engaged in a fork and a guide ribbon (not shown) of a typewriter provided for receiving the cassette. The ribbon passes next onto a guide member 24 and is wound on the receiving bobbin 5. The cassette includes a blocking member 25 forming part of the receiving bobbin 5 and is intended to prevent unwinding of the bobbin when the cassette is withdrawn from the typewriter. This member comprises a lever 26 including a nose 27 intended to engage between the teeth 28 of a toothed wheel 29 angularly integral with the receiving spool 5. The lever 26 is made of an elastic material, for example, of synthetic resin and is integral with the bottom 2 of the case 1. It is disposed in such a manner so as to support nose 27 in a flexible manner against the teeth 28. When the cassette is mounted on the typewriter, a part 30 integral with the fastening mechanism of the cassette (not shown) permits removal of nose 27 from the tooth 28 against the tension exerted by the lever 26.

It is understood that the above described embodiment is not limiting in nature and numerous modifications can be made without changing the spirit of the invention.

In particular, the light conducting member 17 could be achieved by two luminous inwardly curved guides of circular cross-section, two ends of the guides being disposed opposite one another and the two other ends being disposed opposite the source of light and the detector respectively.

I claim:

1. Means for detecting the end of a ribbon (6) for a typewriter having a cassette comprising a case (1), a supply spool (4) and a receiving spool (5) in said case, drive means (7) engageable with said receiving spool, said receiving spool receiving used ribbon, said detecting means including an optical reader (14) comprising a light source (15) emitting a luminous flux to illuminate a portion of said ribbon (6) and a detector (16) for detecting the luminous flux coming from said illuminated portion of ribbon, said light source and said detector fixed on said typewriter and adapted to respectively transmit and receive parallel beams of luminous flux with said beams in turn parallel to the transverse extent of said ribbon (6), characterized in that said cassette includes luminous flux transmitting means comprising two light guides (18,19) integral with the case (1), one of said guides (18) disposed adjacent one side of said ribbon so as to transmit the flow of light emitted by said light source (15) to that one side of said ribbon (6), the other of said guides (19) disposed adjacent an opposite side of said ribbon so as to receive the luminous flow of light which transverses the ribbon and to transmit that luminous flow of light to said detector (16), said luminous flux transmitting means (17) integral with the case of the cassette and said light guides (18,19) comprising two parallel prismatic bodies each having a longitudinal axis and with upper ends including two faces oriented relative to the longitudinal axis of each of said bodies so as to reflect the light from one of said guides (18) towards the other guide (19) with said ribbon (6) being moved between said two faces.

* * * * *